US008475994B2

(12) United States Patent
Kmiecik-lawrynowicz et al.

(10) Patent No.: US 8,475,994 B2
(45) Date of Patent: Jul. 2, 2013

(54) TONER COMPOSITIONS

(75) Inventors: Grazyna E. Kmiecik-lawrynowicz, Fairport, NY (US); Robert D. Bayley, Fairport, NY (US); Maura A. Sweeney, Irondequoit, NY (US); Mark E. Mang, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/216,166

(22) Filed: Aug. 23, 2011

(65) Prior Publication Data

US 2013/0052581 A1 Feb. 28, 2013

(51) Int. Cl.
*G03G 5/00* (2006.01)

(52) U.S. Cl.
USPC ..... 430/137.14

(58) Field of Classification Search
USPC ..... 430/137.14
See application file for complete search history.

(56) References Cited

U.S. PATENT DOCUMENTS

| | | | |
|---|---|---|---|
| 2,874,063 | A | 2/1959 | Greig |
| 3,590,000 | A | 6/1971 | Palermiti |
| 3,655,374 | A | 4/1972 | Palermiti et al. |
| 3,720,617 | A | 3/1973 | Chatterji et al. |
| 3,983,045 | A | 9/1976 | Jugle et al. |
| 4,265,990 | A | 5/1981 | Stolka et al. |
| 4,563,408 | A | 1/1986 | Lin et al. |
| 4,584,253 | A | 4/1986 | Lin et al. |
| 4,935,326 | A | 6/1990 | Creatura et al. |
| 4,937,166 | A | 6/1990 | Creatura et al. |
| 5,223,368 | A | 6/1993 | Ciccarelli et al. |
| 5,227,460 | A | 7/1993 | Mahabadi et al. |
| 5,324,613 | A | 6/1994 | Ciccarelli et al. |
| 5,346,797 | A | 9/1994 | Kmiecik-Lawrynowicz et al. |
| 5,364,729 | A | 11/1994 | Kmiecik-Lawrynowicz et al. |
| 5,403,693 | A | 4/1995 | Patel et al. |
| 5,418,108 | A | 5/1995 | Kmiecik-Lawrynowicz et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,853,943 | A | 12/1998 | Cheng et al. |
| 6,004,714 | A | 12/1999 | Ciccarelli et al. |
| 6,165,668 | A | 12/2000 | Wilson et al. |
| 6,190,815 | B1 | 2/2001 | Ciccarelli et al. |
| 6,221,550 | B1 | 4/2001 | Wilson et al. |
| 6,652,634 | B1 | 11/2003 | Akers, Jr. et al. |
| 2003/0191263 | A1 | 10/2003 | Yoshida et al. |
| 2003/0232268 | A1 * | 12/2003 | Sacripante et al. ..... 430/137.14 |
| 2004/0002014 | A1 | 1/2004 | Chae et al. |
| 2009/0047593 | A1 | 2/2009 | Vanbesien et al. |

FOREIGN PATENT DOCUMENTS

| | | |
|---|---|---|
| EP | 1 383 011 A1 | 1/2004 |

* cited by examiner

*Primary Examiner* — Mark A Chapman
(74) *Attorney, Agent, or Firm* — Pillsbury Winthrop Shaw Pittman LLP

(57) ABSTRACT

A toner having charge control agents which impart excellent triboelectric charging characteristics. In embodiments, the toner particles are washed with a solution containing metal ions that impart desirable charging characteristics to the toner particles.

20 Claims, No Drawings

TONER COMPOSITIONS

BACKGROUND

The present disclosure relates to toners and processes useful in providing toners suitable for electrophotographic apparatuses, including apparatuses such as digital, image-on-image, and similar apparatuses.

Numerous processes are within the purview of those skilled in the art for the preparation of toners. Emulsion aggregation (EA) is one such method. These toners are within the purview of those skilled in the art and toners may be formed by aggregating a colorant with a latex polymer formed by emulsion polymerization. For example, U.S. Pat. No. 5,853,943, the disclosure of which is hereby incorporated by reference in its entirety, is directed to a semi-continuous emulsion polymerization process for preparing a latex by first forming a seed polymer. Other examples of emulsion/aggregation/coalescing processes for the preparation of toners are illustrated in U.S. Pat. Nos. 5,403,693, 5,418,108, 5,364,729, and 5,346,797, the disclosures of each of which are hereby incorporated by reference in their entirety. Other processes are disclosed in U.S. Pat. Nos. 5,527,658, 5,585,215, 5,650,255, 5,650,256 and 5,501,935, the disclosures of each of which are hereby incorporated by reference in their entirety.

Toner systems normally fall into two classes: two component systems, in which the developer material includes magnetic carrier granules having toner particles adhering triboelectrically thereto; and single component systems (SDC), which may use only toner. Placing charge on the particles, to enable movement and development of images via electric fields, is most often accomplished with triboelectricity. Triboelectric charging may occur either by mixing the toner with larger carrier beads in a two component development system or by rubbing the toner between a blade and donor roll in a single component system.

Charge control agents may be utilized to enhance triboelectric charging. Charge control agents may include organic salts or complexes of large organic molecules. Such agents may be applied to toner particle surfaces by a blending process. Such charge control agents may be used in small amounts of from about 0.01 weight percent to about 5 weight percent of the toner to control both the polarity of charge on a toner and the distribution of charge on a toner. Although the amount of charge control agents may be small compared to other components of a toner, charge control agents may be important for triboelectric charging properties of a toner. These triboelectric charging properties, in turn, may impact imaging speed and quality, as well as allow for extended life performance. Examples of charge control agents include those found in EP Patent Application No. 1426830, U.S. Pat. No. 6,652,634, EP Patent Application No. 1383011, U.S. Patent Application Publication No. 2004/0002014, U.S. Patent Application Publication No. 2003/0191263, U.S. Pat. No. 6,221,550, and U.S. Pat. No. 6,165,668, the disclosures of each of which are totally incorporated herein by reference.

One issue that may arise with surface added charge control agents is they may be unevenly distributed and beaten into the surface over time, causing a drastic decrease in charge and thus ultimately impacting life performance of the toner.

Improved methods for producing toner, which permit excellent control of the charging of toner particles, remain desirable.

SUMMARY

According to aspects illustrated herein, there is provided a process for producing toner comprising adding an optional colorant and an optional wax to an emulsion comprising at least one resin to form particles, aggregating the particles to form aggregated particles, coalescing the aggregated particles to form toner particles, washing the toner particles with a solution including a metal ion selected from the group consisting of zinc, chromium, aluminum, calcium, magnesium, barium, strontium, beryllium and combinations thereof, and recovering the toner particles.

In another embodiment, there is provided a process for producing toner comprising adding a colorant, an optional wax, an optional charge control agent, and an aggregating agent to an emulsion comprising at least one resin to form particles, aggregating the particles to form aggregated particles, coalescing the aggregated particles to form toner particles, washing the toner particles at least one time with deionized water, washing the toner particles with a solution including a metal ion selected from the group consisting of zinc, calcium, chromium, aluminum, magnesium, barium, strontium, beryllium, and combinations thereof, the solution including the metal ion at a concentration of from about 0.01% to about 10%, and recovering the toner particles.

In yet further embodiments, there is provided a process for producing toner comprising adding a colorant selected from the group consisting of dyes, pigments, combinations of dyes, combinations of pigments, and combinations of dyes and pigments, an optional wax, an optional charge control agent, and an aggregating agent to an emulsion comprising at least one resin selected from the group consisting of styrenes, acrylates, methacrylates, butadienes, isoprenes, acrylic acids, methacrylic acids, acrylonitriles, and combinations thereof to form particles, aggregating the particles to form aggregated particles, coalescing the aggregated particles to form toner particles, washing the toner particles at least one time with deionized water, washing the toner particles with a solution including a metal ion selected from the group consisting of zinc, calcium, chromium, aluminum, magnesium, barium, strontium, beryllium, and combinations thereof at a concentration of from about 0.01% to about 10%, the metal ion solution being added at a rate of from about 1 drop/min to about 120 drops/min, and recovering the toner particles.

DETAILED DESCRIPTION OF EMBODIMENTS

The present disclosure provides toners and processes for the preparation of toner particles having excellent charging characteristics. Toners of the present disclosure may be prepared with a washing step after coalescence to enhance charging of the toner particles. The washing may include a solution possessing metal ions that provide a charge to the toner particles. For example, in embodiments, toner particles may be subjected to a zinc wash to increase negative charge of the particles. In other embodiments, toner particles may be subjected to a calcium wash to increase positive charge of the particles.

In embodiments, toners of the present disclosure may be prepared by combining a latex polymer with an optional colorant, an optional wax, and other optional additives. While the latex polymer may be prepared by any method within the purview of those skilled in the art, in embodiments the latex polymer may be prepared by emulsion polymerization methods, including semi-continuous emulsion polymerization, and the toner may include emulsion aggregation toners. Emulsion aggregation involves aggregation of both submicron latex and pigment particles into toner size particles, where the growth in particle size is, for example, in embodiments from about 0.1 micron to about 15 microns.

Resin

Any monomer suitable for preparing a latex for use in a toner may be utilized. As noted above, in embodiments the toner may be produced by emulsion aggregation. Suitable monomers useful in forming a latex polymer emulsion, and thus the resulting latex particles in the latex emulsion, include, but are not limited to, styrenes, acrylates, methacrylates, butadienes, isoprenes, acrylic acids, methacrylic acids, acrylonitriles, combinations thereof, and the like.

In embodiments, the latex polymer may include at least one polymer. In embodiments, at least one may be from about one to about twenty and, in embodiments, from about three to about ten. Exemplary polymers include styrene acrylates, styrene butadienes, styrene methacrylates, and more specifically, poly(styrene-alkyl acrylate), poly(styrene-1,3-diene), poly(styrene-alkyl methacrylate), poly (styrene-alkyl acrylate-acrylic acid), poly(styrene-1,3-diene-acrylic acid), poly (styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly (styrene-1,3-diene-acrylonitrile-acrylic acid), poly(alkyl acrylate-acrylonitrile-acrylic acid), poly(styrene-butadiene), poly(methylstyrene-butadiene), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly (methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly (styrene-butadiene-acrylic acid), poly(styrene-butadiene-methacrylic acid), poly (styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), poly (styrene-butyl acrylate-acrylonitrile-acrylic acid), poly (styrene-butadiene), poly(styrene-isoprene), poly(styrene-butyl methacrylate), poly(styrene-butyl acrylate-acrylic acid), poly(styrene-butyl methacrylate-acrylic acid), poly (butyl methacrylate-butyl acrylate), poly(butyl methacrylate-acrylic acid), poly(acrylonitrile-butyl acrylate-acrylic acid), and combinations thereof. The polymers may be block, random, or alternating copolymers.

In addition, polyester resins may be used as the latex polymer. Suitable polyesters which may be used include those obtained from the reaction products of bisphenol A and propylene oxide or propylene carbonate, as well as the polyesters obtained by reacting those reaction products with fumaric acid (as disclosed in U.S. Pat. No. 5,227,460, the entire disclosure of which is incorporated herein by reference), and branched polyester resins resulting from the reaction of dimethylterephthalate with 1,3-butanediol, 1,2-propanediol, and pentaerythritol. In embodiments, combinations of polyester resins, including amorphous polyester resins and crystalline polyester resins, may be utilized. Examples of such polyesters include those disclosed in U.S. Patent Application Publication No. 2009/0047593, the disclosure of which is hereby incorporated by reference in its entirety.

In embodiments, a poly(styrene-butyl acrylate) may be utilized as the latex polymer. The glass transition temperature of this latex, which in embodiments may be used to form a toner of the present disclosure, may be from about 35° C. to about 75° C., in embodiments from about 40° C. to about 70° C., in embodiments from about 45° C. to about 65° C.

In embodiments, the resin used to form a toner may have a weight average molecular weight (Mw) of from about 25 kpse to about 75 kpse, in embodiments from about 30 kpse to about 55 kpse, in other embodiments from about 35 kpse to about 55 kpse. The resin used to form a toner may have a number average molecular weight (Mn) of from about 1 kpse to about 30 kpse, in embodiments from about 2 kpse to about 20 kpse, in other embodiments from about 3 kpse to about 15 kpse. The polydispersity of the resin, i.e., Mw/Mn, may thus be of from about 0.5 to about 15, in embodiments from about 0.75 to about 10, in other embodiments from about 1 to about 5. The amount resin present in the toner may thus be of from about 50% wt/wt to about 90% wt/wt, in further embodiments from about 65% wt/wt to about 85% wt/wt, in other embodiments from about 70% wt/wt to about 80% wt/wt.

Surfactants

In embodiments, the latex may be prepared in an aqueous phase containing a surfactant or co-surfactant. Surfactants which may be utilized with the polymer to form a latex dispersion can be ionic or nonionic surfactants, or combinations thereof, in an amount of from about 0.01 to about 15 weight percent of the solids, in embodiments of from about 0.1 to about 10 weight percent of the solids, in embodiments from about 1 to about 7.5 weight percent solids.

Anionic surfactants which may be utilized include sulfates and sulfonates, sodium dodecylsulfate (SDS), sodium dodecylbenzene sulfonate, sodium dodecylnaphthalene sulfate, dialkyl benzenealkyl sulfates and sulfonates, acids such as abietic acid available from Aldrich, NEOGEN R™, NEOGEN SC™ obtained from Daiichi Kogyo Seiyaku Co., Ltd., combinations thereof, and the like.

Examples of cationic surfactants include, but are not limited to, ammoniums, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, C12, C15, C17 trimethyl ammonium bromides, combinations thereof, and the like. Other cationic surfactants include cetyl pyridinium bromide, halide salts of quaternized polyoxyethylalkylamines, dodecylbenzyl triethyl ammonium chloride, MIRAPOL and ALKAQUAT available from Alkaril Chemical Company, SANISOL (benzalkonium chloride), available from Kao Chemicals, combinations thereof, and the like. In embodiments a suitable cationic surfactant includes SANISOL B-50 available from Kao Corp., which is primarily a benzyl dimethyl alkonium chloride.

Examples of nonionic surfactants include, but are not limited to, alcohols, acids and ethers, for example, polyvinyl alcohol, polyacrylic acid, methalose, methyl cellulose, ethyl cellulose, propyl cellulose, hydroxyl ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy)ethanol, combinations thereof, and the like. In embodiments commercially available surfactants from Rhone-Poulenc such as IGEPAL CA-210 ™, IGEPAL CA-520™, IGEPAL CA-720™, IGEPAL CO-890™, IGEPAL CO-720™, IGEPAL CO-290™, IGEPAL CA-210™, ANTAROX 890™ and ANTAROX 897™ can be utilized.

The choice of particular surfactants or combinations thereof, as well as the amounts of each to be used, are within the purview of those skilled in the art.

Initiators

In embodiments initiators may be added for formation of the latex polymer. Examples of suitable initiators include water soluble initiators, such as ammonium persulfate, sodium persulfate and potassium persulfate, and organic soluble initiators including organic peroxides and azo compounds including Vazo peroxides, such as VAZO 64™, 2-methyl 2-2'-azobis propanenitrile, VAZO 88™, 2-2'-azobis isobutyramide dehydrate, and combinations thereof. Other water-soluble initiators which may be utilized include azoamidine compounds, for example 2,2'-azobis(2-methyl-N-phenylpropionamidine)dihydrochloride, 2,2'-azobis[N-(4-chlorophenyl)-2-methylpropionamidine]di-hydrochloride, 2,2'-azobis[N-(4-hydroxyphenyl)-2-methyl-propionamidine]dihydrochloride, 2,2'-azobis[N-(4-amino-phenyl)-2-methylpropionamidine]tetrahydrochloride, 2,2'-azobis[2-methyl-N(phenylmethyl)propionamidine]dihydrochloride, 2,2'-azobis[2-methyl-N-2-propenylpropionamidine]dihydrochloride, 2,2'-azobis[N-(2-hydroxy-ethyl)2-methylpropionamidine]dihydrochloride, 2,2'-azobis[2(5-methyl-2-imidazolin-2-yl)propane]dihydrochloride, 2,2'-azobis[2-(2-imidazolin-2-yl)propane]dihydrochloride, 2,2'-azobis[2-(4,5,6,7-tetrahydro-1H-1,3-diazepin-2-yl)propane] dihydrochloride, 2,2'-azobis[2-(3,4,5,6-tetrahydropyrimidin-2-yl)propane]dihydrochloride, 2,2'-azobis[2-(5-hydroxy-3,4,5,6-tetrahydropyrimidin-2-yl) propane]dihydrochloride, 2,2'-azobis{2-[1-(2-hydroxyethyl)-2-imidazolin-2-yl]propane}dihydrochloride, combinations thereof, and the like.

Initiators can be added in suitable amounts, such as from about 0.1 to about 8 weight percent of the monomers, in embodiments of from about 0.2 to about 5 weight percent of the monomers, in embodiments from about 0.5 to about 4 weight percent of the monomers.

Chain Transfer Agents

In embodiments, chain transfer agents may also be utilized in forming the latex polymer. Suitable chain transfer agents include dodecane thiol, octane thiol, carbon tetrabromide, combinations thereof, and the like, in amounts from about 0.1 to about 10 percent of monomers, in embodiments from about 0.2 to about 5 percent by weight of monomers, and in embodiments from about 0.5 to about 3.5 percent by weight of monomers, to control the molecular weight properties of the latex polymer when emulsion polymerization is conducted in accordance with the present disclosure.

Functional Monomers

In embodiments, it may be advantageous to include a functional monomer when forming the latex polymer and the particles making up the polymer. Suitable functional monomers include monomers having carboxylic acid functionality. Such monomers may be of the following formula (I):

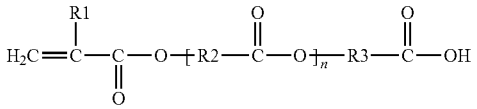

(I)

where R1 is hydrogen or a methyl group; R2 and R3 are independently selected from alkyl groups containing from about 1 to about 12 carbon atoms or a phenyl group; n is from about 0 to about 20, in embodiments from about 1 to about 10. Examples of such functional monomers include beta carboxyethyl acrylate (β-CEA), poly(2-carboxyethyl)acrylate, 2-carboxyethyl methacrylate, combinations thereof, and the like. Other functional monomers which may be utilized include, for example, acrylic acid, methacrylic acid and its derivatives, and combinations of the foregoing.

In embodiments, the functional monomer having carboxylic acid functionality may also contain a small amount of metallic ions, such as sodium, potassium and/or calcium, to achieve better emulsion polymerization results. The metallic ions may be present in an amount from about 0.001 to about 10 percent by weight of the functional monomer having carboxylic acid functionality, in embodiments from about 0.5 to about 5 percent by weight of the functional monomer having carboxylic acid functionality, in embodiments from about 0.75 to about 4 percent by weight of the functional monomer having carboxylic acid functionality.

Where present, the functional monomer may be added in amounts from about 0.01 to about 10 percent by weight of the total monomers, in embodiments from about 0.05 to about 5 percent by weight of the total monomers, and in embodiments from about 0.1 to about 3 percent by weight of total monomers.

Wax

Wax dispersions may also be added during formation of a latex polymer in an emulsion aggregation synthesis. Suitable waxes include, for example, submicron wax particles in the size range of from about 50 to about 1000 nanometers, in embodiments of from about 100 to about 500 nanometers in volume average diameter, suspended in an aqueous phase of water and an ionic surfactant, nonionic surfactant, or combinations thereof. Suitable surfactants include those described above. The ionic surfactant or nonionic surfactant may be present in an amount of from about 0.1 to about 20 percent by weight, and in embodiments of from about 0.5 to about 15 percent by weight of the wax.

The wax dispersion according to embodiments of the present disclosure may include, for example, a natural vegetable wax, natural animal wax, mineral wax, and/or synthetic wax. Examples of natural vegetable waxes include, for example, carnauba wax, candelilla wax, Japan wax, and bayberry wax. Examples of natural animal waxes include, for example, beeswax, punic wax, lanolin, lac wax, shellac wax, and spermaceti wax. Mineral waxes include, for example, paraffin wax, microcrystalline wax, montan wax, ozokerite wax, ceresin wax, petrolatum wax, and petroleum wax. Synthetic waxes of the present disclosure include, for example, Fischer-Tropsch wax, acrylate wax, fatty acid amide wax, silicone wax, polytetrafluoroethylene wax, polyethylene wax, polypropylene wax, and combinations thereof.

Examples of polypropylene and polyethylene waxes include those commercially available from Allied Chemical and Baker Petrolite, wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasel K.K., and similar materials. In embodiments, commercially available polyethylene waxes possess a molecular weight (Mw) of from about 100 to about 5000, and in embodiments of from about 250 to about 2500, while the commercially available polypropylene waxes have a molecular weight of from about 200 to about 10,000, and in embodiments of from about 400 to about 5000.

In embodiments, the waxes may be functionalized. Examples of groups added to functionalize waxes include amines, amides, imides, esters, quaternary amines, and/or carboxylic acids. In embodiments, the functionalized waxes may be acrylic polymer emulsions, for example, JONCRYL 74, 89, 130, 537, and 538, all available from Johnson Diversey, Inc, or chlorinated polypropylenes and polyethylenes commercially available from Allied Chemical, Baker Petrolite Corporation and Johnson Diversey, Inc.

The wax may be present in an amount of from about 0.1 to about 30 percent by weight, and in embodiments from about 2 to about 20 percent by weight of the toner.

Colorants

The latex particles may be added to a colorant dispersion. The colorant dispersion may include, for example, submicron colorant particles having a size of, for example, from about 50 to about 500 nanometers in volume average diameter and, in embodiments, of from about 100 to about 400 nanometers in volume average diameter. The colorant particles may be suspended in an aqueous water phase containing an anionic surfactant, a nonionic surfactant, or combinations thereof. In embodiments, the surfactant may be ionic and may be from about 1 to about 25 percent by weight, and in embodiments from about 4 to about 15 percent by weight, of the colorant.

Colorants useful in forming toners in accordance with the present disclosure include pigments, dyes, mixtures of pigments and dyes, mixtures of pigments, mixtures of dyes, and the like. The colorant may be, for example, carbon black, cyan, yellow, magenta, red, orange, brown, green, blue, violet, or combinations thereof. In embodiments a pigment may be utilized. As used herein, a pigment includes a material that changes the color of light it reflects as the result of selective color absorption. In embodiments, in contrast with a dye which may be generally applied in an aqueous solution, a pigment generally is insoluble. For example, while a dye may be soluble in the carrying vehicle (the binder), a pigment may be insoluble in the carrying vehicle.

In embodiments wherein the colorant is a pigment, the pigment may be, for example, carbon black, phthalocyanines, quinacridones, red, green, orange, brown, violet, yellow, fluorescent colorants including RHODAMINE B™ type, and the like.

The colorant may be present in the toner of the disclosure in an amount of from about 1 to about 25 percent by weight of toner, in embodiments in an amount of from about 2 to about 15 percent by weight of the toner.

Exemplary colorants include carbon black like REGAL 330® magnetites; Mobay magnetites including MO8029™, MO8060™; Columbian magnetites; MAPICO BLACKS™ and surface treated magnetites; Pfizer magnetites including CB4799™, CB5300™, CB5600™, MCX6369™; Bayer magnetites including, BAYFERROX 8600™, 8610™; Northern Pigments magnetites including, NP-604™, NP-608™; Magnox magnetites including TMB-100™, or TMB-104™, HELIOGEN BLUE L6900™, D6840™, D7080™, D7020™, PYLAM OIL BLUE™, PYLAM OIL YELLOW™, PIGMENT BLUE 1™ available from Paul Uhlich and Company, Inc.; PIGMENT VIOLET 1™, PIGMENT RED 48™, LEMON CHROME YELLOW DCC 1026™, E.D. TOLIUIDINE RED™ and BON RED C™ available from Dominion Color Corporation, Ltd., Toronto, Ontario; NOVAPERM YELLOW FGL™, HOSTAPERM PINK E™ from Hoechst; and CINQUASIA MAGENTA™ available from E.I. DuPont de Nemours and Company. Other colorants include 2,9-dimethyl-substituted quinacridone and anthraquinone dye identified in the Color Index as Cl 60710, Cl Dispersed Red 15, diazo dye identified in the Color Index as Cl 26050, Cl Solvent Red 19, copper tetra(octadecyl sulfonamido) phthalocyanine, x-copper phthalocyanine pigment listed in the Color index as Cl 74160, Cl Pigment Blue, Anthrathrene Blue identified in the Color Index as Cl 69810, Special Blue X-2137, diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, Yellow 180 and Permanent Yellow FGL. Organic soluble dyes having a high purity for the purpose of color gamut which may be utilized include Neopen Yellow 075, Neopen Yellow 159, Neopen Orange 252, Neopen Red 336, Neopen Red 335, Neopen Red 366, Neopen Blue 808, Neopen Black X53, Neopen Black X55, wherein the dyes are selected in various suitable amounts, for example from about 0.5 to about 20 percent by weight, in embodiments, from about 5 to about 18 weight percent of the toner.

In embodiments, colorant examples include Pigment Blue 15:3 having a Color Index Constitution Number of 74160, Magenta Pigment Red 81:3 having a Color index Constitution Number of 45160:3, Yellow 17 having a Color index Constitution Number of 21105, and known dyes such as food dyes, yellow, blue, green, red, magenta dyes, and the like.

In other embodiments, a magenta pigment, Pigment Red 122 (2,9-dimethylquinacridone), Pigment Red 185, Pigment Red 192, Pigment Red 202, Pigment Red 206, Pigment Red 235, Pigment Red 269, combinations thereof, and the like, may be utilized as the colorant. Pigment Red 122 (sometimes referred to herein as PR-122) has been widely used in the pigmentation of toners, plastics, ink, and coatings, due to its unique magenta shade. The chemical structures of PR-122, Pigment Red 269, and Pigment Red 185 (sometimes referred to herein as PR-185) are set forth below.

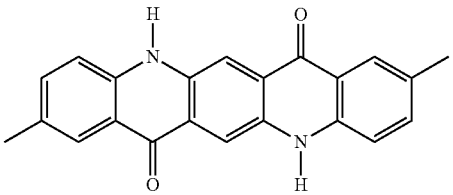

Pigment PR 122 (2,9-dimethylquinacridone)

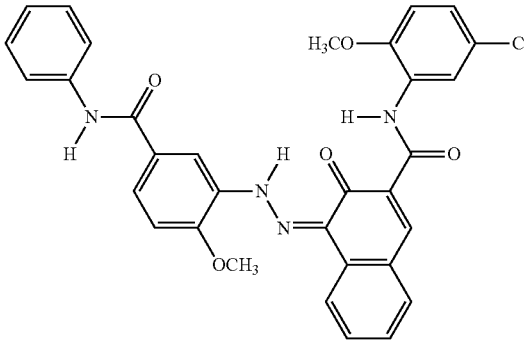

Pigment Red 269

-continued

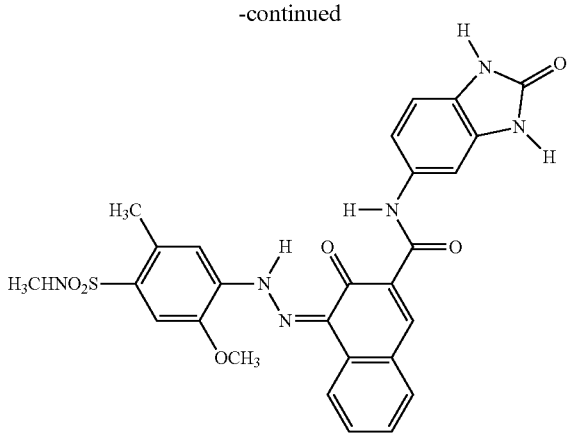

Pigment Red 185 pH Adjustment Agent

In some embodiments a pH adjustment agent may be added to control the rate of the emulsion aggregation process. The pH adjustment agent utilized in the processes of the present disclosure can be any acid or base that does not adversely affect the products being produced. Suitable bases can include metal hydroxides, such as sodium hydroxide, potassium hydroxide, ammonium hydroxide, and optionally combinations thereof. Suitable acids include nitric acid, sulfuric acid, hydrochloric acid, citric acid, acetic acid, and optionally combinations thereof. The amount of the base addition may thus be of from about 0.1% wt/wt to about 20% wt/wt, in other embodiments from about 0.2% wt/wt to about 10% wt/wt, in further embodiments from about 0.5% wt/wt to about 5% wt/wt.

Coagulants

In embodiments, a coagulant may be added during or prior to aggregating the latex and the aqueous colorant dispersion. The coagulant may be added over a period of time from about 1 minute to about 60 minutes, in embodiments from about 1.25 minutes to about 20 minutes, in embodiments from about 2 minutes to about 15 minutes, depending on the processing conditions.

Examples of suitable coagulants include polyaluminum halides such as polyaluminum chloride (PAC), or the corresponding bromide, fluoride, or iodide, polyaluminum silicates such as polyaluminum sulfo silicate (PASS), and water soluble metal salts including aluminum chloride, aluminum nitrite, aluminum sulfate, potassium aluminum sulfate, calcium acetate, calcium chloride, calcium nitrite, calcium oxylate, calcium sulfate, magnesium acetate, magnesium nitrate, magnesium sulfate, zinc acetate, zinc nitrate, zinc sulfate, combinations thereof, and the like. One suitable coagulant is PAC, which is commercially available and can be prepared by the controlled hydrolysis of aluminum chloride with sodium hydroxide. Generally, PAC can be prepared by the addition of two moles of a base to one mole of aluminum chloride. The species is soluble and stable when dissolved and stored under acidic conditions if the pH is less than about 5. The species in solution is believed to contain the formula $Al_{13}O_4(OH)_{24}(H_2O)_{12}$ with about 7 positive electrical charges per unit.

In embodiments, suitable coagulants include a polymetal salt such as, for example, polyaluminum chloride (PAC), polyaluminum bromide, or polyaluminum sulfosilicate. The polymetal salt can be in a solution of nitric acid, or other diluted acid solutions such as sulfuric acid, hydrochloric acid, citric acid or acetic acid. The coagulant may be added in amounts from about 0.01 to about 5 percent by weight of the toner, in embodiments from about 0.1 to about 3 percent by weight of the toner, and in embodiments from about 0.5 to about 2 percent by weight of the toner.

Aggregating Agents

Any aggregating agent capable of causing complexation might be used in forming toner of the present disclosure. Both alkali earth metal or transition metal salts can be utilized as aggregating agents. In embodiments, alkali (II) salts can be selected to aggregate sodium sulfonated polyester colloids with a colorant to enable the formation of a toner composite. Such salts include, for example, beryllium chloride, beryllium bromide, beryllium iodide, beryllium acetate, beryllium sulfate, magnesium chloride, magnesium bromide, magnesium iodide, magnesium acetate, magnesium sulfate, calcium chloride, calcium bromide, calcium iodide, calcium acetate, calcium sulfate, strontium chloride, strontium bromide, strontium iodide, strontium acetate, strontium sulfate, barium chloride, barium bromide, barium iodide, and optionally combinations thereof. Examples of transition metal salts or anions which may be utilized as aggregating agent include acetates of vanadium, niobium, tantalum, chromium, molybdenum, tungsten, manganese, iron, ruthenium, cobalt, nickel, copper, zinc, cadmium or silver; acetoacetates of vanadium, niobium, tantalum, chromium, molybdenum, tungsten, manganese, iron, ruthenium, cobalt, nickel, copper, zinc, cadmium or silver; sulfates of vanadium, niobium, tantalum, chromium, molybdenum, tungsten, manganese, iron, ruthenium, cobalt, nickel, copper, zinc, cadmium or silver; and aluminum salts such as aluminum acetate, aluminum halides such as polyaluminum chloride, combinations thereof, and the like. The amount of the aggregating agent addition may thus be of from about 0.01% wt/wt to about 1% wt/wt, in other embodiments from about 0.1% wt/wt to about 0.5% wt/wt, in further embodiments from about 0.15% wt/wt to about 0.3% wt/wt.

Charge Control Agents

A charge control agent (CCA) may be added to the toner particles. In embodiments, the CCA may be added to a latex, optional colorant dispersion, wax, and aggregating agent to incorporate the CCA within the toner particles. In other embodiments, the CCA may be added once the particles have formed as part of a shell. The use of a CCA may be useful for triboelectric charging properties of a toner, because it may impact the imaging speed and quality of the resulting toner.

Suitable charge control agents which may be utilized include, in embodiments, metal complexes of alkyl derivatives of acids such as salicylic acid, other acids such as dicarboxylic acid derivatives, benzoic acid, oxynaphthoic acid, sulfonic acids, other complexes such as polyhydroxyalkanoate quaternary phosphonium trihalozincate, metal complexes of dimethyl sulfoxide, combinations thereof, and the like. Metals utilized in forming such complexes include, but are not limited to, zinc, manganese, iron, calcium, zirconium, aluminum, chromium, combinations thereof, and the like. Alkyl groups which may be utilized in forming derivatives of salicylic acid include, but are not limited to, methyl, butyl, t-butyl, propyl, hexyl, combinations thereof and the like. Examples of such charge control agents include those commercially available as BONTRON® E-84 and BONTRON® E-88 (commercially available from Orient Chemical). BONTRON® E-84 is a zinc complex of 3,5-di-tert-butylsalicylic acid in powder form. BONTRON® E-88 is a mixture of hydroxyaluminium-bis[2-hydroxy-3,5-di-tert-butylbenzoate] and 3,5-di-tert-butylsalicylic acid. Other suitable CCAs include the calcium complex of 3,5-di-tert-butylsalicylic acid, a zirconium complex of 3,5-di-tert-butylsalicylic acid, and an aluminum complex of 3,5-di-tert-butylsalicylic acid, as disclosed in U.S. Pat. Nos. 5,223,368 and 5,324,613, the disclosures of each of which are incorporated by reference in their entirety, combinations thereof, and the like.

Where utilized, the charge control agent may be present in an amount of from about 0.01 percent by weight to about 10 percent by weight of the toner particle, in embodiments from about 0.05 percent by weight to about 5 percent by weight of the toner particle, in embodiments from about 0.1 percent by weight to about 3 percent by weight of the toner particle.

Reaction Conditions

In the emulsion aggregation process, the reactants may be added to a suitable reactor, such as a mixing vessel. The resulting blend of latex, optionally in a dispersion, CCA, optionally in dispersion, optional colorant dispersion, optional wax, optional coagulant, and optional aggregating agent, may then be stirred and heated to a temperature at or above the glass transition temperature (Tg) of the latex, in embodiments from about 30° C. to about 70° C., in embodiments of from about 40° C. to about 65° C., in embodiments from about 45° C. to about 60° C., for a period of time from about 0.2 hours to about 6 hours, in embodiments from about 0.3 hours to about 5 hours, in embodiments from about 0.5 hours to about 3 hours, resulting in toner aggregates of from about 3 microns to about 15 microns in volume average diameter, in embodiments of from about 4 microns to about 8 microns in volume average diameter, in embodiments from about 5 microns to about 7 microns in volume average diameter.

In embodiments, a shell may be formed on the aggregated particles. Any latex utilized noted above to form the core latex may be utilized to form the shell latex. In embodiments, a styrene-n-butyl acrylate copolymer may be utilized to form the shell latex. In embodiments, the latex utilized to form the shell may have a glass transition temperature of from about 35° C. to about 75° C., in embodiments from about 40° C. to about 70° C.

Where present, a shell latex may be applied by any method within the purview of those skilled in the art, including dipping, spraying, and the like. The shell latex may be applied until the desired final size of the toner particles is achieved, in embodiments from about 3 microns to about 12 microns, in other embodiments from about 4 microns to about 8 microns, in other embodiments from about 5 microns to about 7 microns. In other embodiments, the toner particles may be prepared by in-situ seeded semi-continuous emulsion copolymerization of the latex with the addition of the shell latex once aggregated particles have formed.

Once the desired final size of the toner particles is achieved, the pH of the mixture may be adjusted with a base to a value of from about 3.5 to about 7, and in embodiments from about 4 to about 6.5. The base may include any suitable base such as, for example, alkali metal hydroxides such as, for example, sodium hydroxide, potassium hydroxide, and ammonium hydroxide. The alkali metal hydroxide may be added in amounts from about 0.1 to about 30 percent by weight of the mixture, in embodiments from about 0.5 to about 15 percent by weight of the mixture.

The toner particles may be subsequently coalesced. Coalescing may include stirring and heating at a temperature of from about 80° C. to about 100° C., in embodiments from about 90° C. to about 98° C., for a period of from about 0.5 hours to about 12 hours, and in embodiments from about 1 hour to about 6 hours. Coalescing may be accelerated by additional stirring.

The pH of the mixture may then be lowered to from about 3.5 to about 6, in embodiments from about 3.7 to about 5.5, with, for example, an acid to coalesce the toner aggregates. Suitable acids include, for example, nitric acid, sulfuric acid, hydrochloric acid, citric acid or acetic acid. The amount of acid added may be from about 0.1 to about percent by weight of the mixture, and in embodiments from about 1 to about 20 percent by weight of the mixture.

The mixture is cooled in a cooling or freezing step. Cooling may be at a temperature of from about 20° C. to about 40° C., in embodiments from about 22° C. to about 30° C. over a period time from about 1 hour to about 8 hours, and in embodiments from about 1.5 hours to about 5 hours.

In embodiments, cooling a coalesced toner slurry includes quenching by adding a cooling medium such as, for example, ice, dry ice and the like, to effect rapid cooling to a temperature of from about 20° C. to about 40° C., and in embodiments of from about 22° C. to about 30° C. Quenching may be feasible for small quantities of toner, such as, for example, less than about 2 liters, in embodiments from about 0.1 liters to about 1.5 liters. For larger scale processes, such as for example greater than about 10 liters in size, rapid cooling of the toner mixture may not be feasible or practical, neither by the introduction of a cooling medium into the toner mixture, nor by the use of jacketed reactor cooling.

After this cooling, the aggregate suspension may be heated to a temperature at or above the Tg of the latex. Where the particles have a core-shell configuration, heating may be above the Tg of the first latex used to form the core and the Tg of the second latex used to form the shell, to fuse the shell latex with the core latex. In embodiments, the aggregate suspension may be heated to a temperature of from about 80° C. to about 120° C., in embodiments from about 85° C. to about 98° C., for a period of time from about 1 hour to about 6 hours, in embodiments from about 2 hours to about 4 hours.

Washing

The toner slurry may then be washed. Washing may be carried out at a pH of from about 7 to about 12, and in embodiments at a pH of from about 9 to about 11. The washing may be at a temperature of from about 30° C. to about 70° C., in embodiments from about 40° C. to about 67° C. The washing may include filtering and reslurrying a filter cake including toner particles in deionized water. The filter cake may be washed one or more times by deionized water, or washed by a single deionized water wash at a pH of about 4 wherein the pH of the slurry is adjusted with an acid, and followed optionally by one or more deionized water washes. In embodiments, the particles may be washed about three times with water.

For example, in embodiments, toner particles may be washed in 40° C. deionized water, filtered, reslurried with HCl acid addition, filtered, and reslurried in fresh deionized water. The washes may continue until the solution conductivity of the filtrate is measured to be low (less than 10 microsiemens per centimeter), which indicates that the ion content is significantly reduced and will not interfere with the metal, in embodiments zinc, treatment.

In embodiments, the particles may then be subjected to an additional washing step including a metal in solution to enhance their charging characteristics. An increase in the amount of certain metal based charging agents, in embodiments zinc salicylate or other similar agent, on the surface of a toner particle may increase the charging of the toner particles. Thus, in accordance with the present disclosure, a washing step including such a metal may increase the charging of the toner particles.

In embodiments, a toner wet cake may be re-dispersed in water, in embodiments deionized water, and heated to a temperature of from about from about 20° C. to about 50° C., in embodiments from about 35° C. to about 45° C., in other embodiments about 40° C., and a solution including a metal, based charging agent, in embodiments, zinc salicylate, chromium salicylate, aluminum salicylate or other metal based charge control agents, may be added thereto and mixed so that the metal salicylate attaches to the surface of the toner particles. Suitable sources of metal charging agents in this wash solution may include zinc acetate, zinc butyrate, zinc chlorate, zinc chloride, zinc bromide, zinc citrate, zinc fluoride, zinc salicylate, aluminum salicylate, zinc fluoride tetrahydrate, zinc 3,5-ditertiarybutylsalicylic acid, aluminum 3,5-ditertiarybutylsalicylic acid combinations thereof, and the like. The metal ion may be in solution at a concentration of from about 0.01% to about 10%, in embodiments from about 0.1% to about 3%.

The washing the toner particles with the metal ion solution may take place at a temperature of from about 30° C. to about 50° C. The metal ion solution, in embodiments including zinc, is added dropwise to the slurry in an amount of from about 1 to about 120 drops. The metal ion solution is added dropwise to the slurry at a rate of from about 1 drops/min to about 120 drops/min, in embodiments from about 5 drops/min to about 100 drops/min, in embodiments from about 10 drops/min to about 60 drops/min, and mixed for a period of from about 0.5 hours to about 1.5 hours, in embodiments from about 0.75 hours to about 1.25 hours, in embodiments about 1 hour. During this time of mixing, the slurry is slightly heated from about 20° C. to about 60° C., in other embodiments from about 30° C. to about 55° C., in further embodiments from about 35° C. to about 45° C. The zinc attaches to the toner surface in a controlled manner without aggregating the particles together.

The treated toner may then be filtered and redispersed in deionized water, then freeze dried for about 48 hours. The drying may be continued until the moisture level of the particles is of from about 0% to about 1% by weight, in embodiments from about 0.1% to about 0.7% by weight.

In accordance with the present disclosure, the addition of a metal ion such as zinc as part of a final wash of the toner particles, after coalescence and other washes described above, increases the negative charge of the particles. This washing step can be used by itself, or in conjunction with incorporating a CCA. Any suitable CCA may be utilized, including those described above. In embodiments, a CCA such as 3,5 Di-tert-butylsalicylic acid, zinc or other metal charging agent may be added to improve charging in all zones and the life of the toner.

In embodiments, toners of the present disclosure that have been subjected to a wash with a metal, in embodiments zinc, may have a triboelectric charge of from about −2 μC/g to about −60 μC/g, in embodiments from about −10 μC/g to about −40 μC/g. Toners of the present disclosure may also possess a parent toner charge per mass ratio (Q/M) of from about −3 μC/g to about −35 μC/g, and a final toner charging after surface additive blending of from −10 μC/g to about −45 μC/g.

In other embodiments, other metal sources may be utilized to adjust the triboelectric charge of the toner particles. For example, in embodiments, calcium, such as calcium from calcium chloride, magnesium chloride, barium chloride, strontium chloride, beryllium chloride, combinations thereof, and the like, may be added to the wash instead of zinc to impart a more positive charge to the toner. Washing with these metals may occur following the same processes described above with respect to solutions including zinc. Toners subjected to a wash with a calcium compound may have a triboelectric charge of from about 1 μC/g to about 60 μC/g, in embodiments from about 10 μC/g to about 45 μC/g.

Additives

Further optional additives which may be combined with a toner include any additive to enhance the properties of toner compositions. Included are surface additives, color enhancers, etc. Surface additives that can be added to the toner compositions after washing or drying include, for example, metal salts, metal salts of fatty acids, colloidal silicas, metal oxides, strontium titanates, combinations thereof, and the like, which additives are each usually present in an amount of from about 0.1 to about 10 weight percent of the toner, in embodiments from about 0.5 to about 7 weight percent of the toner. Examples of such additives include, for example, those disclosed in U.S. Pat. Nos. 3,590,000, 3,720,617, 3,655,374 and 3,983,045, the disclosures of each of which are hereby incorporated by reference in their entirety. Other additives include zinc stearate and AEROSIL R972® available from Degussa. The coated silicas of U.S. Pat. No. 6,190,815 and U.S. Pat. No. 6,004,714, the disclosures of each of which are hereby incorporated by reference in their entirety, can also be selected in amounts, for example, of from about 0.05 to about 5 percent by weight of the toner, in embodiments from about 0.1 to about 2 percent by weight of the toner. These additives can be added during the aggregation or blended into the formed toner product.

Toner particles produced utilizing a latex of the present disclosure may have a size of about 1 micron to about 20 microns, in embodiments about 2 microns to about 15 microns, in embodiments about 3 microns to about 7 microns. Toner particles of the present disclosure may have a circularity of from about 0.9 to about 0.99, in embodiments from about 0.92 to about 0.98.

Following the methods of the present disclosure, toner particles may be obtained having several advantages compared with conventional toners: (1) increase in the robustness of the particles' triboelectric charging, which reduces toner defects and improves machine performance; (2) easy to implement, no major changes to existing aggregation/coalescence processes; and (3) increase in productivity and reduction in unit manufacturing cost (UMC) by reducing the production time and the need for rework (quality yield improvement).

Uses

Toner in accordance with the present disclosure can be used in a variety of imaging devices including printers, copy machines, and the like. The toners generated in accordance with the present disclosure are excellent for imaging processes, especially xerographic processes and are capable of providing high quality colored images with excellent image resolution, acceptable signal-to-noise ratio, and image uniformity. Further, toners of the present disclosure can be selected for electrophotographic imaging and printing processes such as digital imaging systems and processes.

Developer compositions can be prepared by mixing the toners obtained with the processes disclosed herein with known carrier particles, including coated carriers, such as steel, ferrites, and the like. Such carriers include those disclosed in U.S. Pat. Nos. 4,937,166 and 4,935,326, the entire disclosures of each of which are incorporated herein by reference. The carriers may be present from about 2 percent by weight of the toner to about 8 percent by weight of the toner, in embodiments from about 4 percent by weight to about 6 percent by weight of the toner. The carrier particles can also include a core with a polymer coating thereover, such as polymethylmethacrylate (PMMA), having dispersed therein a conductive component like conductive carbon black. Carrier coatings include silicone resins such as methyl silsesquioxanes, fluoropolymers such as polyvinylidiene fluoride, mixtures of resins not in close proximity in the triboelectric series such as polyvinylidiene fluoride and acrylics, thermosetting resins such as acrylics, combinations thereof and other known components.

Development may occur via discharge area development. In discharge area development, the photoreceptor is charged and then the areas to be developed are discharged. The development fields and toner charges are such that toner is repelled by the charged areas on the photoreceptor and attracted to the discharged areas. This development process is used in laser scanners.

Development may be accomplished by the magnetic brush development process disclosed in U.S. Pat. No. 2,874,063, the disclosure of which is hereby incorporated by reference in its entirety. This method entails the carrying of a developer material containing toner of the present disclosure and magnetic carrier particles by a magnet. The magnetic field of the magnet causes alignment of the magnetic carriers in a brush like configuration, and this "magnetic brush" is brought into contact with the electrostatic image bearing surface of the photoreceptor. The toner particles are drawn from the brush to the electrostatic image by electrostatic attraction to the discharged areas of the photoreceptor, and development of the image results. In embodiments, the conductive magnetic brush process is used wherein the developer includes conductive carrier particles and is capable of conducting an electric current between the biased magnet through the carrier particles to the photoreceptor.

Imaging

Imaging methods are also envisioned with the toners disclosed herein. Such methods include, for example, some of the above patents mentioned above and U.S. Pat. Nos. 4,265,990, 4,584,253 and 4,563,408, the entire disclosures of each of which are incorporated herein by reference. The imaging process includes the generation of an image in an electronic printing magnetic image character recognition apparatus and thereafter developing the image with a toner composition of the present disclosure. The formation and development of images on the surface of photoconductive materials by electrostatic means is well known. The basic xerographic process involves placing a uniform electrostatic charge on a photoconductive insulating layer, exposing the layer to a light and shadow image to dissipate the charge on the areas of the layer exposed to the light, and developing the resulting latent electrostatic image by depositing on the image a finely-divided electroscopic material, for example, toner. The toner will normally be attracted to those areas of the layer, which retain a charge, thereby forming a toner image corresponding to the latent electrostatic image. This powder image may then be transferred to a support surface such as paper. The transferred image may subsequently be permanently affixed to the support surface by heat. Instead of latent image formation by uniformly charging the photoconductive layer and then exposing the layer to a light and shadow image, one may form the latent image by directly charging the layer in image configuration. Thereafter, the powder image may be fixed to the photoconductive layer, eliminating the powder image transfer. Other suitable fixing means such as solvent or overcoating treatment may be substituted for the foregoing heat fixing step.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

0.8% Zinc 3,5-Ditertiarybutyl Salicylate Wash

In the final washing step 0.8% wt/wt of 3,5-ditertiarybutylsalicylic acid was adjusted by sodium hydroxide to solubilize in the aqueous solution. To the 14% slurry, the 0.8% 3,5-ditertiarybutyl salicylate was added dropwise. After mixing for several minutes, an equal amount of zinc chloride solution was added to the slurry and the slurry was mixed for another 40 minutes. A slight viscosity increase was noted in the slurry after the salt addition. After mixing the slurry was sieved, washed and dried in the usual manner then additives were blended onto the surface for improved flow and additional charging properties.

Example 2

0.4% Zinc 3,5-Ditertiarybutyl Salicylate Wash

In the final washing step 0.4% wt/wt of 3,5-ditertiarybutylsalicylic acid was adjusted by sodium hydroxide to solubilize in the aqueous solution. To the 14% slurry, the 0.4% 3,5-ditertiarybutyl salicylate was added dropwise. After mixing for several minutes, an equal amount of zinc chloride solution was added to the slurry and the slurry was mixed for another 40 minutes. A lesser viscosity increase than that of the 0.8% was noted in the slurry after the salt addition. After mixing the slurry was sieved, washed and dried in the usual manner then additives were blended onto the surface for improved flow and additional charging properties.

Example 3

1% Zinc Salicylate Wash

In the final washing step 1% wt/wt of salicylic acid was adjusted by 0.5% sodium hydroxide to solubilize in the aqueous solution. To the 14% slurry, the 1% salicylate was added dropwise. After mixing for several minutes, 1% of zinc chloride solution was added to the slurry and the slurry was mixed for another 50 minutes. After mixing the slurry was sieved, washed and dried in the usual manner then additives were blended onto the surface for improved flow and additional charging properties. It was noted that the surface zinc was at 10,000 ppm after this experiment. An additional experiment was performed using 0.3% zinc salicylate with lowered amounts of surface zinc noted.

Example 4

1% Zinc 3,5-Ditertiarybutyl Salicyclic Acid

In the final washing step 1% wt/wt of zinc 3,5-ditertiarybutyl salicylic acid was dissolved in 75% ethanol and mixed for several minutes. To the slurry this mixture was added and mixed at elevated temperature (40 C) for 50 minutes. After mixing, the slurry was sieved, washed and dried in the usual manner then additives were blended onto the surface for improved flow and additional charging properties.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A process for producing toner comprising:

adding an optional colorant and an optional wax to an emulsion comprising at least one resin to form particles;

aggregating the particles to form aggregated particles;

coalescing the aggregated particles to form toner particles;

washing the toner particles with a solution including a metal ion selected from the group consisting of zinc, chromium, aluminum, calcium, magnesium, barium, strontium, beryllium and combinations thereof, wherein the metal ion is provided by a metal salt which attaches to the surface of the toner particle; and recovering the toner particles;

wherein the at least one resin is selected from the group consisting of styrenes, acrylates, methacrylates, butadienes, isoprenes, acrylic acids, methacrylic acids, acrylonitriles, and combinations thereof.

2. The process of claim 1, wherein the optional colorant comprises dyes, pigments, combinations of dyes, combinations of pigments, and combinations of dyes and pigments.

3. The process of claim 1, wherein the metal salt is selected from the group consisting of zinc acetate, zinc butyrate, zinc chlorate, zinc chloride, zinc bromide, zinc citrate, zinc fluoride, zinc salicylate, zinc fluoride tetrahydrate, aluminum salicylate, zinc 3,5-diteriarybutylsalicylic acid, aluminum 3,5-ditertiarybutylsalicylic acid, and combinations thereof.

4. The process of claim 3, wherein the toner particles possess a triboelectric charge of from about −2 μC/g to about −60 μC/g.

5. The process of claim 1, wherein the metal salt is selected from the group consisting of calcium chloride, magnesium chloride, barium chloride, strontium chloride, beryllium chloride, and combinations thereof.

6. The process of claim 5, wherein the toner particles possess a triboelectric charge of from about 1 μC/g to about 60 μC/g.

7. The process of claim 1, wherein the solution includes metal ions at a concentration of from about 0.01% to about 10%.

8. The process of claim 1, wherein washing the toner particles occurs at a temperature of from about 30° C. to about 50° C., wherein the solution including the metal ions is added in an amount of from about 1 drop to about 120 drops, and wherein washing further comprises mixing at a rate of from about 100 rpm to about 300 rpm for a period of from about 0.5 hours to about 1.5 hours.

9. The process of claim 1, further comprising contacting the toner particles with at least one charge control agent while in solution during the washing step.

10. A process for producing toner comprising:

adding a colorant, an optional wax, an optional charge control agent, and an aggregating agent to an emulsion comprising at least one resin to form particles;

aggregating the particles to form aggregated particles;

coalescing the aggregated particles to form toner particles;

washing the toner particles at least one time with deionized water;

washing the toner particles with a solution including a metal ion selected from the group consisting of zinc, calcium, chromium, aluminum, magnesium, barium, strontium, beryllium, and combinations thereof, the solution including the metal ion at a concentration of from about 0.01% to about 10%, wherein the metal ion is provided by a metal salt which attaches to the surface of the toner particle; and recovering the toner particles;

wherein the at least one resin is selected from the group consisting of styrenes, acrylates, methacrylates, butadienes, isoprenes, acrylic acids, methacrylic acids, acrylonitriles, and combinations thereof.

11. The process of claim 10, wherein the resin is selected from the group consisting of poly(styrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate isoprene), poly(methyl acrylate-isoprene), poly(ethyl acrylate-isoprene), poly(propyl acrylate-isoprene), poly(butyl acrylate-isoprene), poly(styrene-butyl acrylate), poly(styrene-butadiene), poly(styrene-isoprene), poly(styrene-butyl methacrylate), poly(styrene-butyl acrylate-acrylic acid), poly(styrene-butadiene-acrylic acid), poly(styrene-isoprene-acrylic acid), poly(styrene-butyl methacrylate-acrylic acid), poly(butyl methacrylate-butyl acrylate), poly(butyl methacrylate-acrylic acid), poly(styrene-butyl acrylate-acrylonitrile-acrylic acid), poly(acrylonitrile-butyl acrylate-acrylic acid), and combinations thereof.

12. The process of claim 10, wherein the metal salt is selected from the group consisting of zinc acetate, zinc butyrate, zinc chlorate, zinc chloride, zinc bromide, zinc citrate, zinc fluoride, zinc salicylate, zinc fluoride tetrahydrate, aluminum salicylate, zinc 3,5-diteriarybutylsalicylic acid, aluminum 3,5-ditertiarybutylsalicylic acid, and combinations thereof, and wherein the toner particles possess a triboelectric charge of from about −2 μC/g to about −60 μC/g.

13. The process of claim 10, wherein the metal salt is selected from the group consisting of calcium chloride, magnesium chloride, barium chloride, strontium chloride, beryllium chloride, and combinations thereof, and wherein the toner particles possess a triboelectric charge of from about 1 μC/g to about 60 μC/g.

14. The process of claim 10, wherein washing the toner particles occurs at a temperature of from about 30° C. to about 50° C., wherein the solution including the metal ions is added at a rate of from about 1 drop/min to about 120 drops/min, and wherein washing further comprises mixing at a rate of from about 100 rpm to about 300 rpm for a period of from about 0.5 hours to about 1.5 hours.

15. The process of claim 10, further comprising contacting the toner particles with at least one charge control agent, wherein the toner particles possess a core/shell configuration, and wherein the charge control agent is present in the core, the shell, or both, in an amount of from about 0.01 to about 10 percent by weight of the toner particle.

16. A process for producing toner comprising:

adding a colorant selected from the group consisting of dyes, pigments, combinations of dyes, combinations of pigments, and combinations of dyes and pigments, an optional wax, an optional charge control agent, and an aggregating agent to an emulsion comprising at least one resin selected from the group consisting of styrenes, acrylates, methacrylates, butadienes, isoprenes, acrylic acids, methacrylic acids, acrylonitriles, and combinations thereof to form particles;

aggregating the particles to form aggregated particles;

coalescing the aggregated particles to form toner particles;

washing the toner particles at least one time with deionized water;

washing the toner particles with a solution including a metal ion selected from the group consisting of zinc, calcium, chromium, aluminum, magnesium, barium, strontium, beryllium, and combinations thereof at a concentration of from about 0.01% to about 10%, the metal ion solution being added at a rate of from about 1 drop/min to about 120 drops/min, wherein the metal ion is provided by a metal salt which attaches to the surface of the toner particle; and recovering the toner particles.

17. The process of claim 16, wherein the metal salt is selected from the group consisting of zinc acetate, zinc butyrate, zinc chlorate, zinc chloride, zinc bromide, zinc citrate, zinc fluoride, zinc salicylate, zinc fluoride tetrahydrate, zinc 3,5-diteriarybutylsalicylic acid, aluminum 3,5-ditertiarybutylsalicylic acid, and combinations thereof, and wherein the toner particles possess a triboelectric charge of from about −2 μC/g to about −60 μC/g.

18. The process of claim 16, wherein the metal salt is selected from the group consisting of calcium chloride, magnesium chloride, barium chloride, strontium chloride, beryllium chloride, and combinations thereof, and wherein the toner particles possess a triboelectric charge of from about −2 μC/g to about −60 μC/g.

19. The process of claim 16, wherein washing the toner particles occurs at a temperature of from about 30° C. to about 50° C., and wherein washing further comprises mixing at a rate of from about 100 rpm to about 300 rpm for a period of from about 0.5 hours to about 1.5 hours.

20. The process of claim 16, further comprising contacting the toner particles with at least one charge control agent, wherein the toner particles possess a core/shell configuration, and wherein the charge control agent is present in the core, the shell, or both.

* * * * *